United States Patent [19]

Suhr

[11] Patent Number: 4,944,720

[45] Date of Patent: Jul. 31, 1990

[54] TAB FORMING DISPENSER WITH TAPE PASSING UNDER THE CUTTER

[76] Inventor: Robert N. Suhr, 431 Chowning Pl., NW., Marietta, Ga. 30064

[21] Appl. No.: 386,730

[22] Filed: Jul. 31, 1989

[51] Int. Cl.[5] ..... B26F 3/02

[52] U.S. Cl. ..... 493/466; 225/1; 225/25; 493/353

[58] Field of Search ..... 493/353, 419, 466; 225/1, 25

[56] References Cited

U.S. PATENT DOCUMENTS

| | | | |
|---|---|---|---|
| 2,300,423 | 11/1942 | Holben | 225/25 |
| 2,526,494 | 10/1950 | McNeil | 225/25 |
| 3,810,567 | 5/1974 | Malcolm | 225/91 |
| 4,540,393 | 9/1985 | Knoop | 493/466 |

*Primary Examiner*—Hien H. Phan

[57] ABSTRACT

A tab-forming apparatus for forming a tab on the end of the outstretched tape on a tape dispenser, the tape dispenser being of the type where the outstretched tape passes from the tape roll and under the tape cutter, with the adhesive side of the tape facing down. A joint allows the outer end of the cutter to swing down and onto the tape causing the tape to fold back on itself creating a tab where the two adhesive surfaces contact each other. Two short positioning projections hold the tape in contact with the swinging cutter. The positioning projections located under the adhesive side of the tape having rotating surfaces to reduce the interference with the tape passing over them.

8 Claims, 3 Drawing Sheets

TAB FORMING DISPENSER WITH TAPE PASSING UNDER THE CUTTER

BACKGROUND OF THE INVENTION

1. Field of the Invention

This invention relates to tape dispensers for dispensing lengths of adhesive type tape, and, more particularly, to a tape dispenser that has the means to form a tab on the end of the outstretched tape to prevent the tape from accidentally adhering back to the tape roll.

2. Discussion of the Prior Art

Finding the end of adhesive type tape made of plastic or other flexible materials, that has adhered to the tape roll can be frustrating, time consuming, and sometimes impossible. The end of thin, and sometimes transparent, tape is particularly hard to locate and lift off the roll to enable the user to unwind additional tape from the roll. Frequently, the roll has to be discarded and replaced with a new roll where the end can be found and grasped.

The problem has been addressed in many ways. In U.S. Pat. No. 3,247,956 Rosen discloses an adhesive tape where a stretched elastic thread along the length of the tape contracts and puckers the cut end of the tape to enable the end to be grasped. This solution requires a special manufactured tape.

In U.S. Pat. No. 4,512,462 Dills discloses a reusable tape tab that can be repeatedly attached to the end of the outstretched tape. Such tabs can be easily misplaced and lost.

The present invention has to do with the particular type of tape dispensers where the outstretched tape passes under the cutter with the adhesive side of the tape facing down. Such dispensers usually have positioning projections protruding from the base sides and located under the adhesive side of the tape to support the tape when it sags or falls. After the tape cutter severs a length of tape, the loose end of the remaining outstretched tape is then supposed to adhere to these positioning projections and remain in position to be grasped and pulled. There is a severe problem in that the adhesive side of the tape accidentally touches and adheres to these positioning projections as the tape is being pulled from the roll. Also the outstretched end of the tape can accidentally pull back from, or between the positioning projections and then adhere to the tape roll.

Of course the outstretched end of the tape can be folded back to create a tab by the operator using his fingers. However, on the type of dispenser where the non-adhesive side of the tape is in contact with the cutter above it, it is difficult to grasp any portion of the tape except the adhesive side. The fingers then adhere to the tape and it is difficult to fold the tape to form the desired tab.

Usually a new unused roll of tape is sold with a short paper tab adhering to the end of the tape to form a nonsticking end tab so the user can grasp the end of the tape to unwind it from the roll. This tab is available only once for the first length of tape pulled off the roll.

SUMMARY OF THE INVENTION

Accordingly, it is the object of the present invention to provide a tape dispenser with the means to form a tab on the end of the outstretched tape that will be available to pull additional tape from the roll.

Another object of the present invention is to provide a tab-forming means that does not require a special manufactured type of tape.

Another object of the present invention is to provide a tab-forming means that does not require the use of an additional piece of plastic, metal, or paper to form the tab.

Another object of the present invention is to provide a tab-forming means where the operator does not have to touch the tape.

Another object of the present invention is to provide positioning projections with surfaces that turn or rotate as the adhesive side of the tape touches them as it is pulled over them.

Another object of the present invention is to provide a tape dispenser with tab-forming means that is inexpensive to manufacture, durable in structure, and efficient in operation.

These objects and others are accomplished by a type of tape dispenser where the tape is pulled from the roll and under the cutter with the adhesive side of the tape facing down. These types of dispensers are frequently used with box sealing tape.

The cutter is connected to the dispenser base by means of a joint that allows the cutter to swing in an approximately 180 degree arc down and onto the outstretched tape, causing the tape to bend back on itself, causing the adhesive side of the tape to bond to itself to form a tab on the end of the outstretched tape.

Two short positioning projections are located on the base of the dispenser and generally under the joint that allows the cutter to swing. The joint means has a cut out area that allows it to swing over the projections without contacting them. The positioning projections are located under the tape so that when the swinging cutter begins to force the outstretched tape down, the projections cause the tape to be held in contact with the swinging cutter and fold the adhesive side of the tape back on itself to form a tab. The resultant tab can be easily twisted slightly in the opening between the projections and cause the outer portion of the tab to slide off the two short projections.

The positioning projections that are located under the adhesive side of the tape have surfaces that rotate as the tape contacts them as the tape is pulled over them. The rolling surface allows the tape to pass without dragging or any other type of interference.

Other objects, features, and advantages of the present invention will become apparent from the following description when taken in conjunction with the accompanying drawing wherein like characters of reference designate corresponding parts throughout the several views.

DETAILED DESCRIPTION OF A PREFERRED EMBODIMENT

Figure 1:
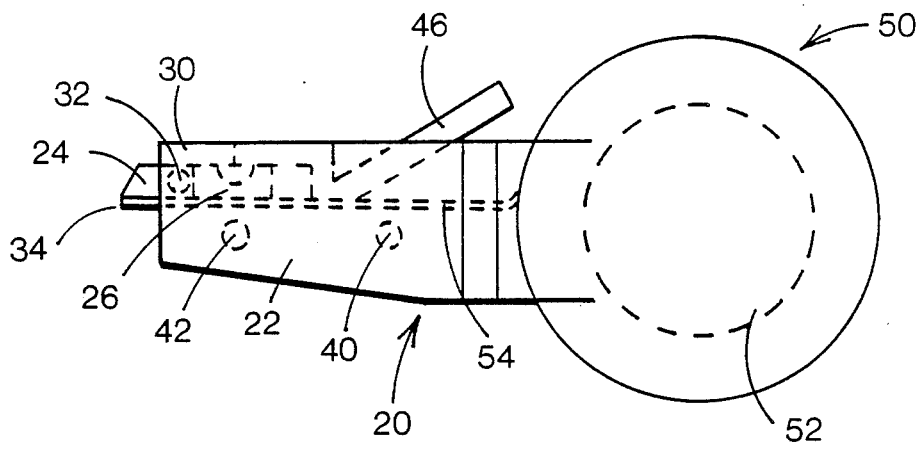
FIG. 1 is a side view of one form of tape dispenser constructed in accordance with the present invention.

Referring now to FIGS. 1–4 which represent in detail the embodiment chosen for the purpose of illustrating the present invention, the tape dispenser of the present invention is denoted generally by the numeral 20. The roll of tape is denoted generally by the numeral 50. In FIG. 1, the outstretched tape 54 is shown passing from the roll 50 to the cutter 24, with its adhesive side facing down. The outstretched tape 54 passes over the long positioning projections 40 and the short positioning projections 42 and then under the cutter 24. This type of tape dispenser is frequently used with boxing tape where the exposed adhesive side of the tape, which is facing down, is pressed against the box to be sealed, causing the tape to adhere to the box. The tape dispenser 20 is then held in the operator's hand, by means of the support holder 52 and with the index finger on the finger grip 46, and the dispenser 20 is pulled along the surface of the box to be sealed causing the tape 54 to unroll from the roll 50. When sufficient tape has been applied to the box, the operator forces the cutter edge 34 of the cutter 24 against the tape and severs it. The process is then repeated until the box is sealed.

Figure 2:
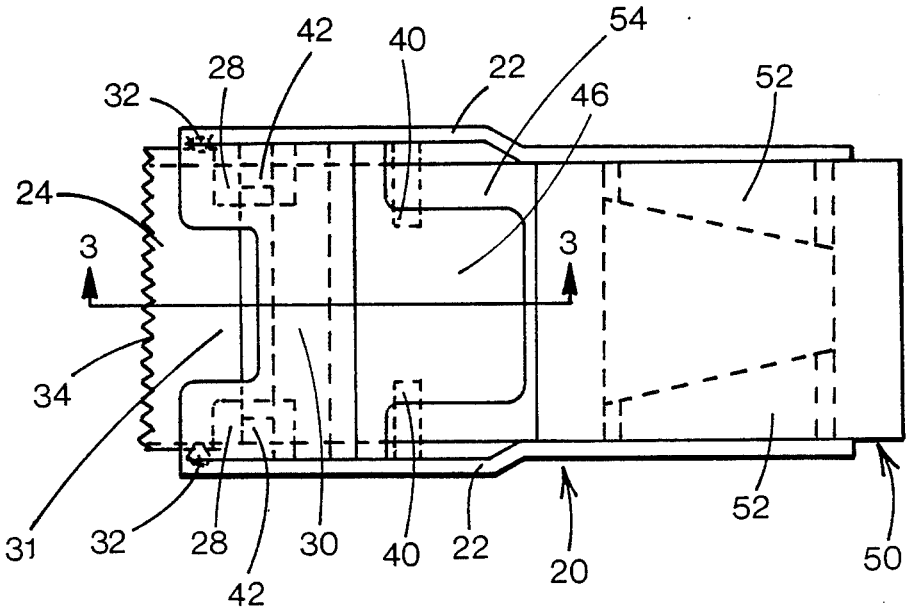
FIG. 2 is a top plan view of FIG. 1.

According to the present invention the tape dispenser 20 includes a base 22 having two parallel walls. FIG. 2 shows the base extending along both outside edges of the dispenser 20. Two support holders 52 are attached to the two sides of the base 22 in an area where the two sides of the base 22 can be spread apart. A roll of tape 50 is then positioned so when the two sides of the base 22 return to their normal non-spread position, the two support holders 52 are inside the hollow core of the tape roll 50 and hold the tape roll 50 in a position to unroll.

Figure 4:
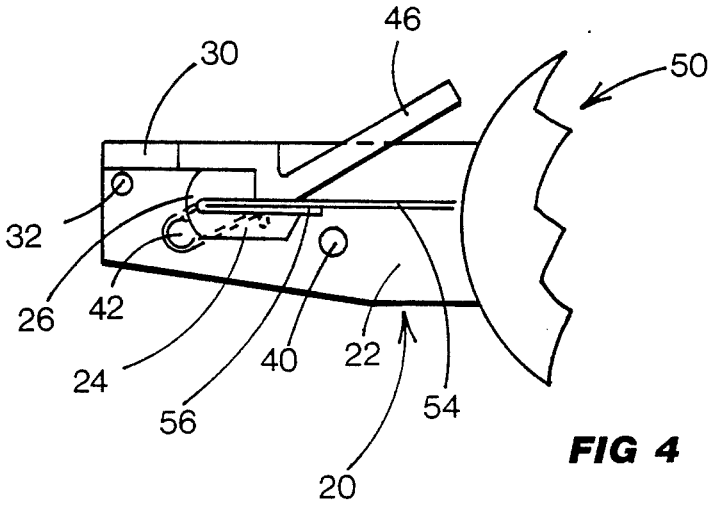
FIG. 4 shows the same tape dispenser in FIG. 3 with the cutter swing back approximately 180 degrees.

FIG. 1 shows the swinging cutter 24 in its normal straight position with the cutter edge 34 in position to be forced against outstretched tape 54 to sever the tape. The swinging cutter 24 has a cutter joint 26 which allows the outer end of the cutter 24 to swing through an arc of approximately 180 degrees, as shown in FIG. 4. The swinging cutter 24, along with its cutter joint 26, can be a one piece molded plastic part.

The swinging cutter is held in position as follows. The inner end of the cutter 24, that is closest to the tape roll 50, is attached to the base 22. The overhead cutter stop 30 prevents the outer end of the cutter 24 from swinging up when cutting the outstretched tape 54. FIG. 2 shows two cutter retaining projections 32 attached to the base 22. These projections fit into two recesses on the edge of the outer end of the swinging cutter 24, to prevent the cutter 24 from swinging down against the outstretched tape 54 before it is desired to do so.

FIG. 2 shows two short positioning projections 42 located generally under the cutter joint 26. The outer ends of the cutter joint 26 are cut away to form openings 28 to allow the cutter 24 to swing through its approximately 180 degree arc without contacting the short positioning projections 42.

Figure 3:
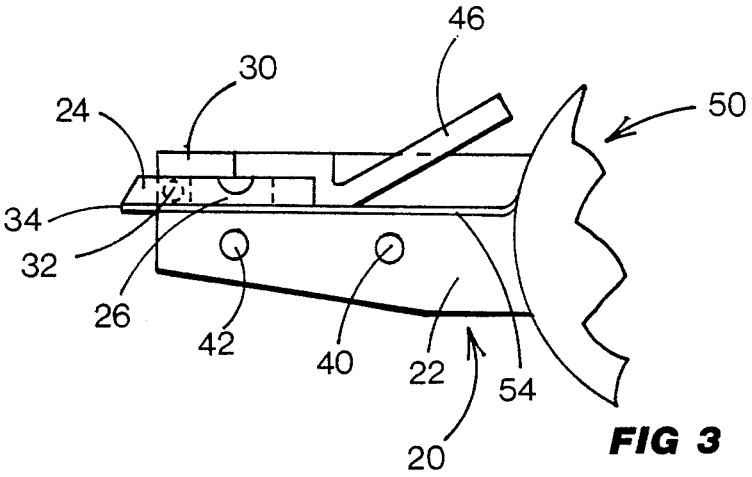
FIG. 3 is a cross-sectional view substantially along the lines 3—3 in FIG. 2.

FIG. 3 shows the outstretched tape 54 having been pulled from the roll 50 to the outer end of the cutter 24 and having been severed by the cutter edge 34.

To form a tab, as shown in FIG. 4, the operator forces the outer end of the swinging cutter 24 down and out of contact with the cutter retaining projections 32, by pushing on the top of the cutter 24 in the cut out opening 31 in the overhead cutter stop. The cutter joint 26 allows the outer end of the cutter 24 to swing down and through an approximate 180 degree arc and fold back into a generally horizontal position. The outstretched tape 54 under the outer end of the cutter 24, is forced downward as the cutter 24 swings. The two short positioning projections 42 hold the outstretched tape 54 in contact with the cutter 24 as it swings. Therefore, as the cutter 24 swings back on itself, it folds the outstretched tape 54 over the two short positioning projections 42 and back on itself, causing two adhesive surfaces to contact each other and form the tab 56. The outer end of the cutter 24 is then swung back into its generally straight horizontal position and the two cutter retaining projections 32 hold it in that position.

The tab 56 is held in position as its two outer edges are folded over the short positioning projections 42. If the tape dispenser is mishandled and stored with other items between uses, the tab 56 so held will not accidentally be pulled further off the tape roll 50.

When it is desired to dispense additional tape from the roll 50, the tab 56 can be easily twisted in the opening between the two short positioning projections 42 and removed from them. The tab is then pulled beyond the cutter edge 34 and severed, and the tape dispenser 20 is ready for further use.

Figure 5:
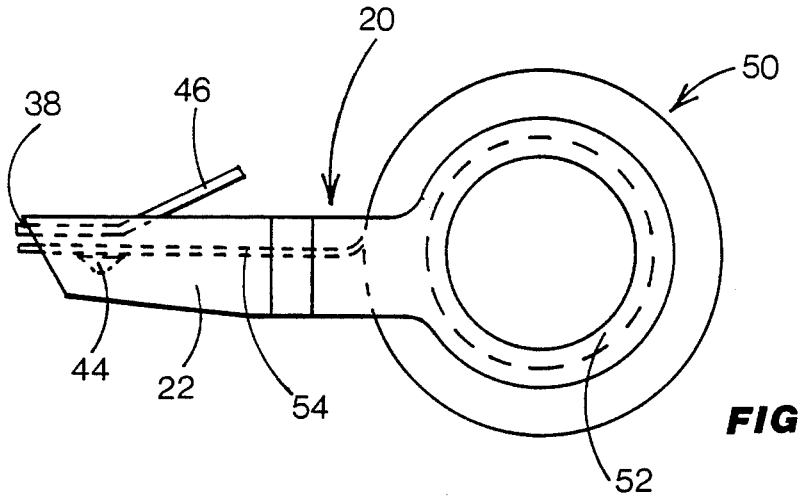
FIG. 5 is a side view of a conventional tape dispenser where the tape passes under the cutter.
Figure 6:
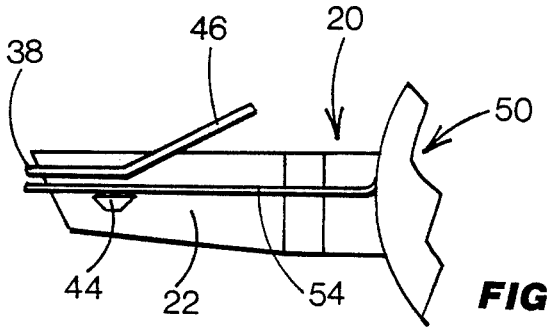
FIG. 6 is a view in section of FIG. 5.
Figure 7:
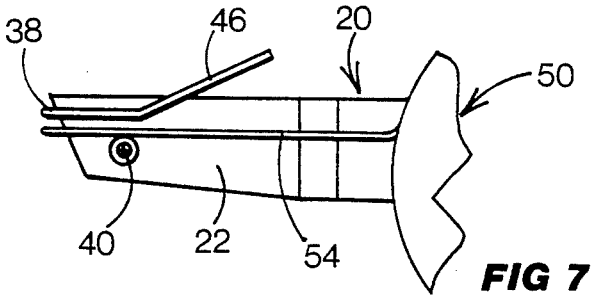
FIG. 7 is a modified form or improved version of the tape dispenser in FIG. 6 according to the present invention.

FIGS. 5 and 6 are side views of a conventional design tape dispenser 20. The outstretched tape 54 is pulled from the roll 50 and under the stationary cutter 38, with the adhesive side down. The outstretched tape 54 passes over the non-rotating positioning projections 44 and as it sags and falls onto these positioning projections 44 it adheres to them and interferes with the tape being pulled further off the roll 50. FIG. 7 shows the same design tape dispenser 20 but with rotating positioning projections 46 under the tape instead of the stationary projections 44. As the tape sags and falls onto these rotating positioning projections 46 and adheres to them, the surfaces turn and allow the tape to be pulled from the roll 50 much more easily.

In FIGS. 1–4 the long positioning projections 40 and the short positioning projections 42 also have rotating surfaces to minimize the interference with the outstretched tape 54 passing over them.

It will be obvious to those skilled in the art that many variations may be made in the embodiments chosen for the purpose of illustrating the best mode of making and using the present invention without departing from the scope thereof as defined by the appended claims.

What is claimed is:

1. A method of forming a tab on the end of an adhesive tape on a tape dispenser, comprising the steps of:
   (a) pulling a length of outstretched tape from a tape roll on the dispenser to a swingable cutter on the dispenser;
   (b) passing the tape under the cutter, with the adhesive side of the tape facing down and away from said cutter; and
   (c) swinging the cutter in an arc of approximately 180 degrees downwardly and onto the outstretched tape causing a leading portion of the tape to fold back on itself such that the adhesive side of a leading portion of the leading portion bonds to the adhesive side of the remaining portion of the outstretched tape to form a tab at the end of the outstretched tape.

2. The tab-forming method as recited in claim 1, wherein said step of passing the tape under the cutter including:

passing the tape over two short positioning projections located below a means for holding the cutter for swinging with;

the two short positioning projections allowing the leading portion to maintain contact with the cutter when the cutter is swung downwardly in the subsequent swinging step.

3. Tab-forming method as recited in claim 2, wherein the step of passing the tape over two short positioning projections includes:

pulling the tape with its adhesive side in contact with rotating surfaces provided on the projections.

4. An apparatus for forming a tab on the end of an outstretched tape on a tape dispenser, comprising:

(a) a base having two parallel walls;

(b) a support holder on said base to hold a roll of adhesive tape;

(c) a cutter connected to said base;

(d) an outstretched tape from said roll passing under said cutter with the adhesive side of the said outstretched tape facing down and away from the cutter; and (e) swinging means connecting said cutter to said base and allowing said cutter to swing about an axis in an approximate 180 degree arc down and onto a leading portion of said outstretched tape, causing the leading portion of said tape to fold back on itself such that said adhesive side of said tape bonds to itself to form a tab at the end of the said outstretched tape.

5. The apparatus defined in claim 4 further comprising two positioning projections for supporting said tape located on said base below the adhesive side of said outstretched tape, between said cutter and said tape roll, and spaced from said cutter such that said cutter will not contact said projections when said cutter has swung through an approximate 180 degree arc to form said tab.

6. The apparatus defined in claim 5 wherein said two positioning projections each comprises a rotatable means in contact with said tape, said rotatable means rotate when the tape is withdrawn from the roll.

7. The apparatus defined in claim 4 further comprising two axially aligned and short positioning projections each located are on one of said walls and below said swinging means connecting said cutter to said base;

said cutter comprising two parallel sides, each of said sides having an opening allowing said cutter to swing without contacting the said projections;

said projections extend below and support the longitudinal side edges of said outstretched tape to allow the leading portion of said tape to fold back around the projections by the cutter.

8. The apparatus defined in claim 7 wherein said two short positioning projections comprising rotatable means that are rotated by said tape during withdrawal of the tape.

* * * * *